US008028844B2

(12) United States Patent
Costa et al.

(10) Patent No.: US 8,028,844 B2
(45) Date of Patent: Oct. 4, 2011

(54) SLIDING CLOSET RACK

(76) Inventors: Charles A. Costa, Scottsdale, AZ (US); Kristine Costa, Scottsdale, AZ (US)

( * ) Notice: Subject to any disclaimer, the term of this patent is extended or adjusted under 35 U.S.C. 154(b) by 155 days.

(21) Appl. No.: 12/274,970

(22) Filed: Nov. 20, 2008

(65) Prior Publication Data

US 2010/0122963 A1 May 20, 2010

(51) Int. Cl.
*A47H 1/00* (2006.01)

(52) U.S. Cl. ..... 211/96; 211/104; 211/106.01

(58) Field of Classification Search ..... 211/94.01, 211/104, 96, 105.3, 106.01; 248/307, 308, 248/285.1
See application file for complete search history.

(56) References Cited

U.S. PATENT DOCUMENTS

| | | | | | |
|---|---|---|---|---|---|
| 2,066,374 | A | | 1/1837 | Toulouse | |
| 1,132,190 | A | | 4/1915 | Kohout | |
| 1,213,475 | A | | 1/1917 | Gardner | |
| 1,699,766 | A | | 1/1929 | Starr | |
| 1,833,997 | A | | 12/1931 | Keebler | |
| 1,859,871 | A | | 5/1932 | Harmon | |
| 2,018,002 | A | | 10/1935 | Avery | |
| 2,417,036 | A | * | 3/1947 | Zelenko | 211/96 |
| 2,558,611 | A | | 6/1951 | Emmart | |
| 2,615,592 | A | | 10/1952 | Swedman | |
| 2,663,470 | A | * | 12/1953 | Albert | 223/94 |
| 2,683,890 | A | | 7/1954 | Rosenbaum | |
| 2,776,789 | A | * | 1/1957 | Olpe | 223/96 |
| 2,917,185 | A | | 12/1959 | Kovacs | |
| 3,116,837 | A | * | 1/1964 | Kelly | 211/94.01 |
| 3,160,278 | A | | 12/1964 | Varkala | |
| 3,376,007 | A | * | 4/1968 | Chesterley | 248/285.1 |
| 3,517,825 | A | | 6/1970 | Propst | |
| 3,897,112 | A | * | 7/1975 | Walther et al. | 301/13.2 |
| 3,954,182 | A | | 5/1976 | McEvers | |
| 3,966,157 | A | | 6/1976 | Corral et al. | |
| 3,966,273 | A | | 6/1976 | Hagen et al. | |
| 3,973,814 | A | | 8/1976 | Entrikin | |
| 4,155,609 | A | | 5/1979 | Skafte et al. | |
| 4,220,245 | A | | 9/1980 | Corcoran | |
| 4,282,977 | A | | 8/1981 | Di Lorenzo | |
| 4,508,300 | A | * | 4/1985 | Minick | 248/216.1 |
| 4,569,450 | A | | 2/1986 | Dillingham | |
| 4,862,811 | A | | 9/1989 | Davis | |
| 4,895,332 | A | | 1/1990 | Hansen et al. | |
| 4,961,388 | A | | 10/1990 | Simpson | |
| 4,971,210 | A | | 11/1990 | Blumenkranz et al. | |
| 5,086,936 | A | | 2/1992 | Remmers | |
| 5,215,201 | A | | 6/1993 | Seymour | |

(Continued)

FOREIGN PATENT DOCUMENTS

DE 4335742 A1 4/1995

(Continued)

*Primary Examiner* — Korie H. Chan
(74) *Attorney, Agent, or Firm* — Vidas, Arrett & Steinkraus

(57) ABSTRACT

A hanger assembly includes a sliding rail assembly and a hanger attachment. The sliding rail assembly includes a fixed member, a sliding arm, and a hinge. The hinge has a first portion and a second portion, wherein the first portion is pivotally engaged to the second portion. The first portion is slidably engaged to the fixed member and the second portion is fixedly engaged to the sliding arm. The sliding rail assembly has a non-pivoted state and a pivoted state, wherein in the non-pivoted state the sliding arm is positioned substantially parallel to the fixed member, and in the pivoted state the sliding arm defines an angle with the fixed member. The hanger attachment is engaged to at least a portion of the sliding arm.

11 Claims, 9 Drawing Sheets

U.S. PATENT DOCUMENTS

| | | | | |
|---|---|---|---|---|
| 5,303,997 | A | 4/1994 | Kropf | |
| 5,330,063 | A | 7/1994 | Remmers | |
| 5,337,905 | A | 8/1994 | Gast | |
| 5,425,463 | A | 6/1995 | Toscanini et al. | |
| 5,538,146 | A | 7/1996 | Gast | |
| 5,657,886 | A | 8/1997 | Tacchella | |
| 5,769,372 | A * | 6/1998 | Klosterman | 248/219.4 |
| 5,775,786 | A | 7/1998 | Liebertz | |
| 6,109,462 | A | 8/2000 | Emalfarb et al. | |
| 6,173,871 | B1 | 1/2001 | Woodworth | |
| 6,253,472 | B1 | 7/2001 | Gast | |
| 6,378,968 | B1 | 4/2002 | Weng | |
| 6,416,145 | B1 | 7/2002 | Singh | |
| 6,454,108 | B1 | 9/2002 | Gerard | |
| 6,491,173 | B1 | 12/2002 | Costa | |
| 6,502,705 | B1 | 1/2003 | Ziegler | |
| 6,582,096 | B1 | 6/2003 | Searer | |
| 6,679,392 | B1 | 1/2004 | Costa | |
| 6,694,661 | B1 * | 2/2004 | Langford | 42/94 |
| 6,871,749 | B2 * | 3/2005 | Bostick et al. | 211/94.01 |
| 7,062,871 | B1 | 6/2006 | Smidt | |
| 7,063,219 | B2 | 6/2006 | Fann et al. | |
| 7,100,316 | B2 | 9/2006 | Obileye | |
| 7,124,451 | B2 | 10/2006 | Moore | |
| 7,310,899 | B1 | 12/2007 | Costa | |
| 7,377,397 | B2 | 5/2008 | Lee et al. | |

FOREIGN PATENT DOCUMENTS

| | | |
|---|---|---|
| DE | 198 42 666 | 9/1999 |
| EP | 0 541 306 A1 | 5/1993 |
| GB | 2231783 | 11/1990 |
| GB | 1 480 177 | 7/1997 |

* cited by examiner

SLIDING CLOSET RACK

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

The present invention is directed to a hanger assembly, and in particular, to a stowable sliding hanger assembly that may be installed on a partition via a sliding, pivoting rail assembly.

2. Description of the Related Art

There are currently available many types of tie racks, belt racks, valet rods (garment bag holders) and other hanger racks for hanging articles of clothing thereon. Many such racks include sliding mechanisms to allow the rack to be slid from a retracted position to a more easily accessed extended position.

Such sliding racks include the retractable valet rods described in U.S. Pat. Nos. 5,337,905 and 5,538,146. Other rack assemblies are known that include sliding or otherwise moveable members that may cause hanging members to be actuated. Such assemblies are described in U.S. Pat. Nos. 4,569,450, 5,425,463, and 6,679,392, the entire content of each being expressly incorporated herein by reference.

Hanging racks are known that are varied in design and function. However, a need continues to exist to provide for a hanger assembly that may be mounted to a wall, partition or other member, such that a hanger attachment may be engaged to a sliding rail assembly to allow a user to slidingly extend the hanger attachment from a retracted position to an extended and pivoted position. While hanger assemblies are known, those that are presently available fail to provide a sliding rail assembly that has a smooth sliding action and that pivots for easy access, while also having the ability to mount one or more of a variety of hanger attachments. Various embodiments of the present invention provide for such a hanger assembly, and also provide an assembly that is esthetically pleasing, and which is particularly useful when mounted to a vertical surface a closet wall, partition, door or other member.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. §1.56(a) exists.

All U.S. patents and applications and all other published documents mentioned anywhere in this application are incorporated herein by reference in their entirety.

Without limiting the scope of the invention, a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided for the purposes of complying with 37 C.F.R. §1.72.

BRIEF SUMMARY OF THE INVENTION

In at least one embodiment, the invention is directed to a hanger assembly that comprises a sliding rail assembly and a hanger attachment. The sliding rail assembly comprises a fixed member, a sliding arm, and a hinge. The hinge has a first portion and a second portion, wherein the first portion is pivotally engaged to the second portion, and wherein the first portion is slidably engaged to the fixed member and the second portion is fixedly engaged to the sliding arm. The sliding rail assembly has a non-pivoted state and a pivoted state, wherein in the non-pivoted state the sliding arm is positioned substantially parallel to the fixed member, and in the pivoted state the sliding arm defines an angle with the fixed member. The hanger attachment is engaged to at least a portion of the sliding arm.

In some embodiments, in the pivoted state the angle is between 1 and 90 degrees. In at least one embodiment, in the pivoted state the angle is at least 90 degrees.

In at least one embodiment, the hanger attachment comprises a housing and a hanger member. In some embodiments, the hanger member is a valet rod, tie rack, belt rack, clothing rack, hanger, hook, or any combination thereof.

In at least one embodiment, the fixed member is engaged to a partition.

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

BRIEF DESCRIPTION OF THE SEVERAL VIEWS OF THE DRAWING(S)

A detailed description of the invention is hereafter described with specific reference being made to the drawings.

DETAILED DESCRIPTION OF THE INVENTION

Figure 1:
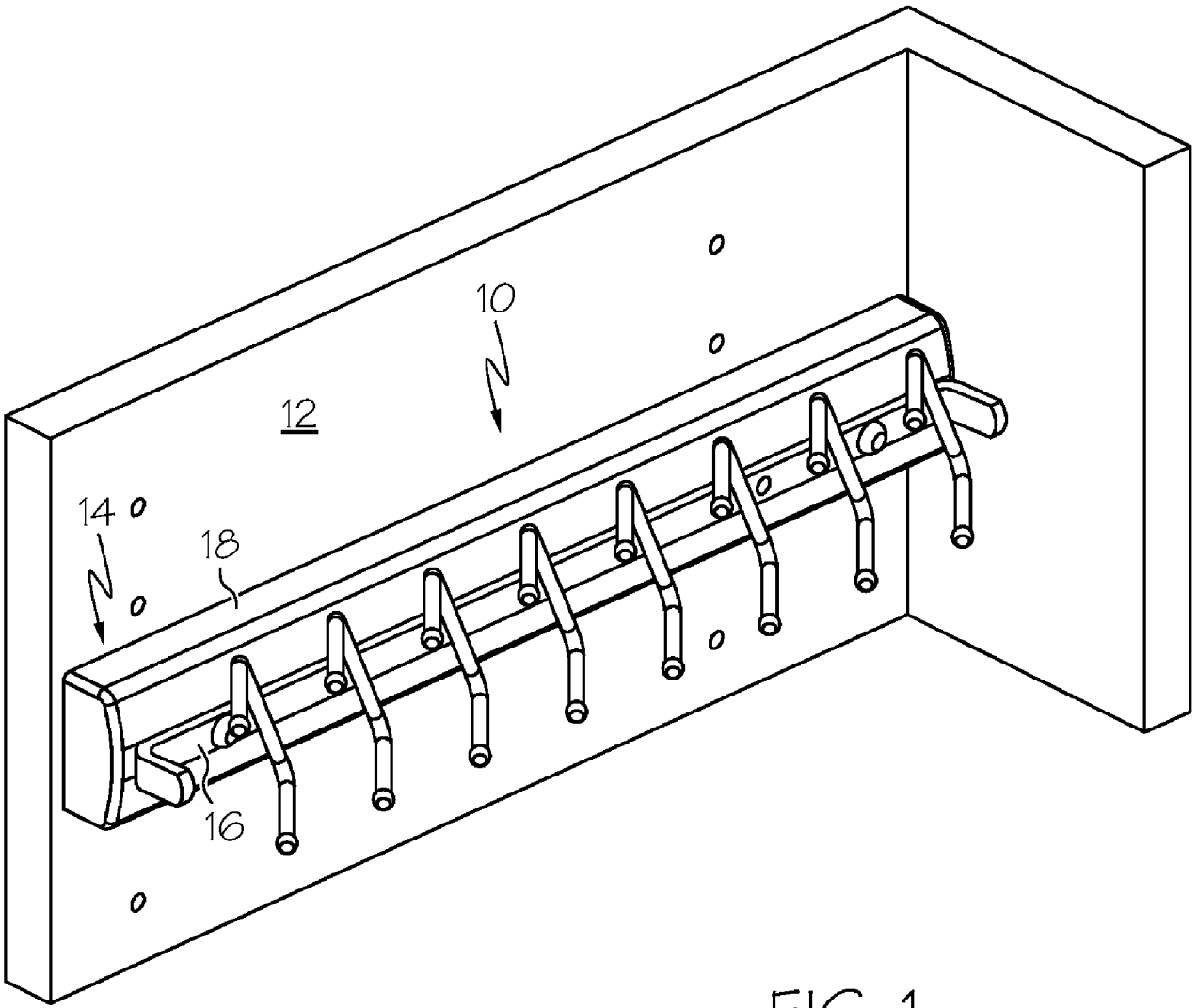
FIG. 1 is a perspective view of a left-mounted embodiment of the invention, depicting a hanger assembly in a stowed position.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

A first embodiment of the invention is depicted in FIG. 1. A remarkably superior hanger assembly is shown in a stowed, retracted, non-pivoted, left-mounted position within a closet. In the various embodiments shown, the assembly 10 is comprised of several components that provide a hanger assembly with a variety of mounting and use positions, and the capacity to be readily moved between them. Although not depicted, it should be noted that some embodiments of the invention are directed to right-mounted hanger assemblies.

While slidable hanger assemblies exist in the prior art, as described above, pivoting is a key feature that until now has been overlooked. Pivoting solves a problem that until now was unrecognized. That is, previous slidable hanger assemblies allowed the hung articles to be brought out of the closet, for example, and inspected and ultimately selected. However, permitting a slidable hanger assembly to pivot allows the user to bring all the hung articles completely out of the closet and into an environment that is better lit, thereby making it easier for the user to select an article. Furthermore, the pivoting solves the problem of leaving the hanger assembly in an extended position for any period of time. It is aesthetically unpleasing to leave a prior art assembly extended from a closet. This means that the user must remember to push the assembly back into the closet each time after use. In the present invention, the pivoted assembly can remain outside of the closet if the user so desires or forgets.

The hanger assembly 10 shown in FIG. 1 is adjacent to and parallel with a partition 12. Although the partition 12 depicted in FIGS. 1-5 and 8-9 are vertical pieces of a closet, it should be noted that the hanger assembly can engage any vertical surface. The hanger assembly in FIG. 1 depicts a hanger attachment 14 that includes a hanger member 16 engaged to a housing 18.

Figure 2:
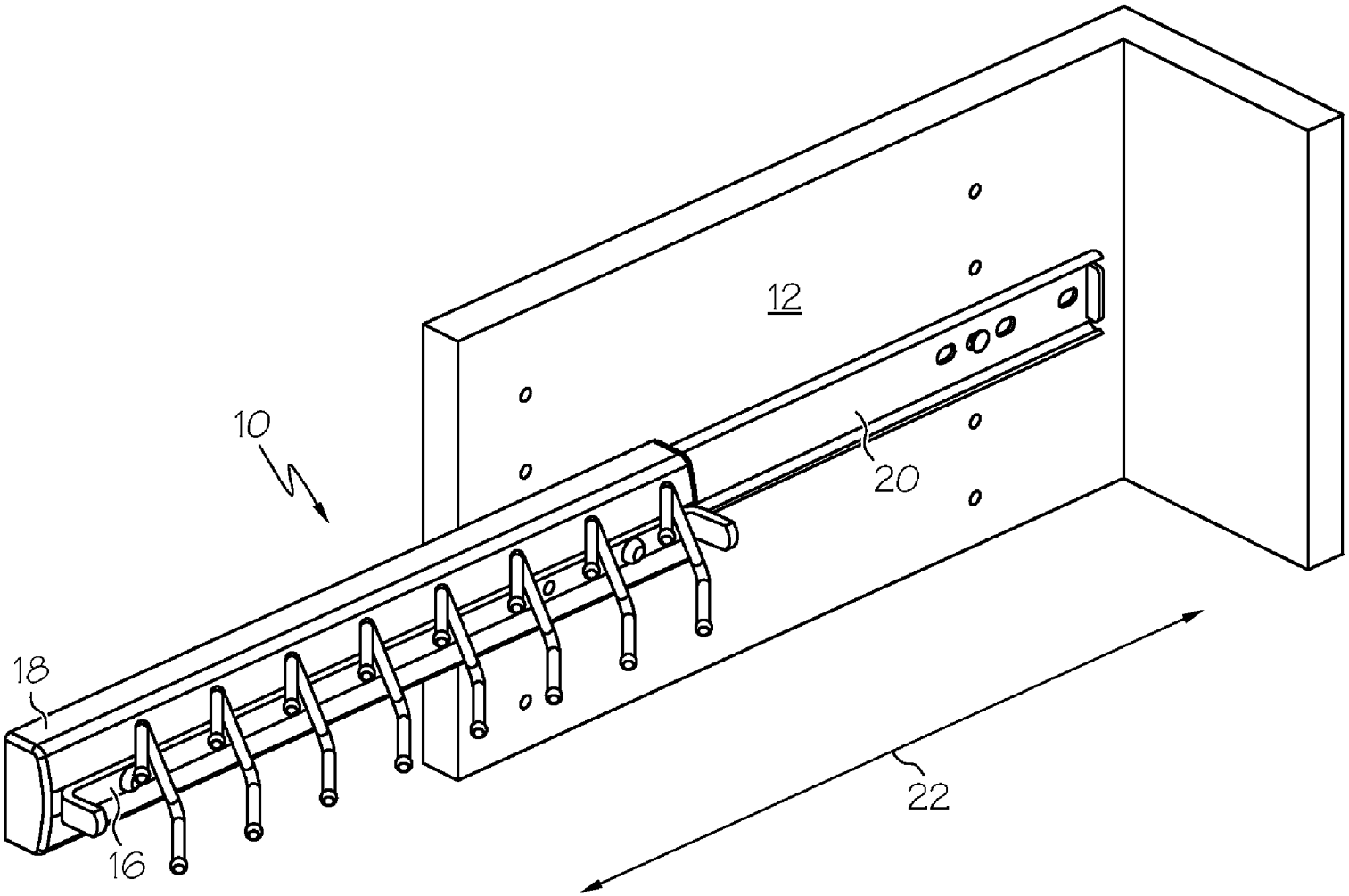
FIG. 2 is a perspective view of the hanger assembly of FIG. 1, shown in a partially extended position.

In FIGS. 2-5 and 8-9, the hanger assembly 14 of FIG. 1 is depicted in various positions as the assembly is being extended out of a closet, for example, and then pivoted. In FIG. 2 the hanger assembly has been slid partially out of the closet, parallel to the partition 12 along fixed member 20 and longitudinal axis 22. The sliding is accomplished by a sliding engagement between a sliding arm, a hinge, and a fixed member, as described in more detail below.

Figure 3:
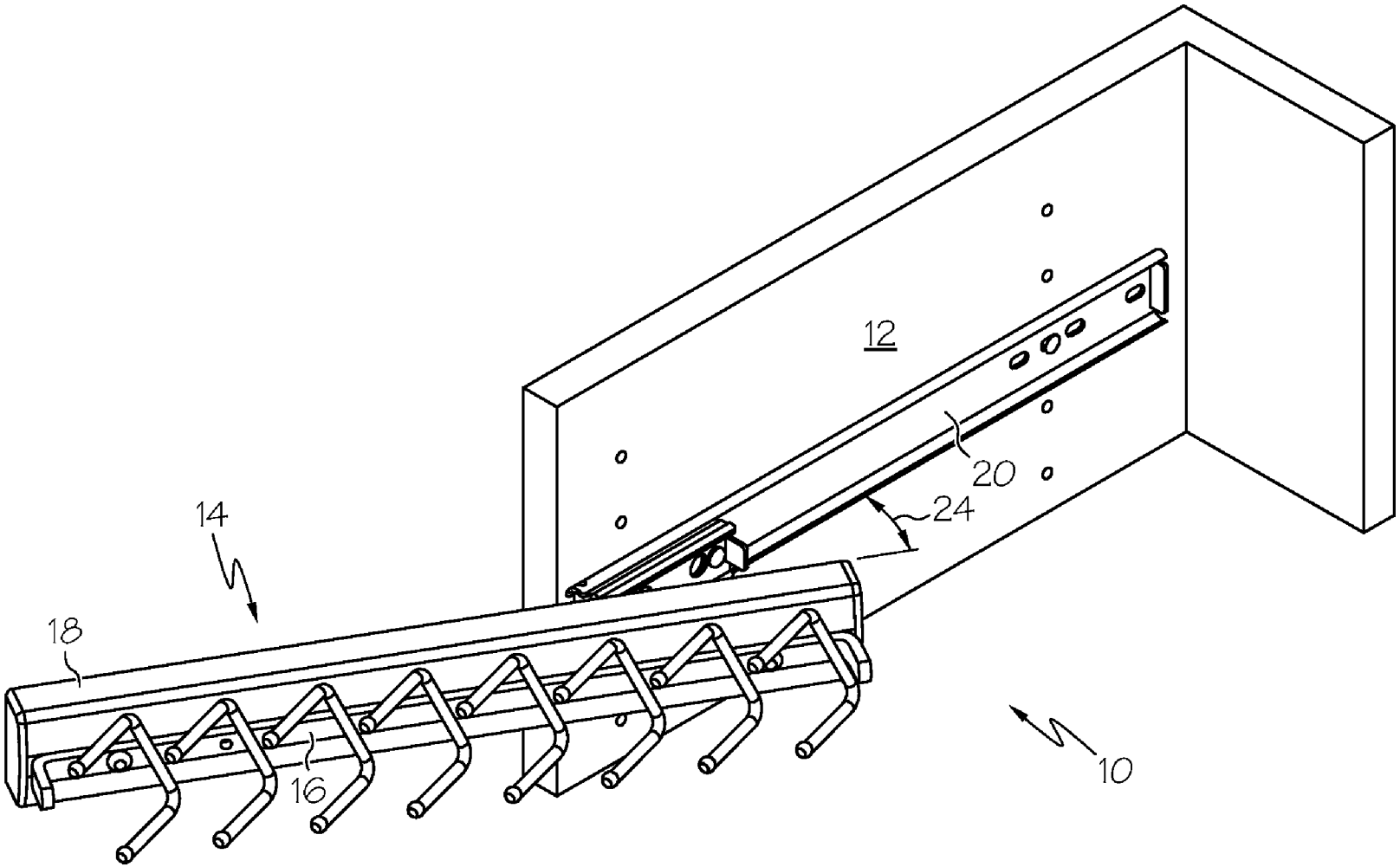
FIG. 3 is a perspective view of the hanger assembly of FIG. 1, shown in a fully extended and partially pivoted position.
Figure 4:
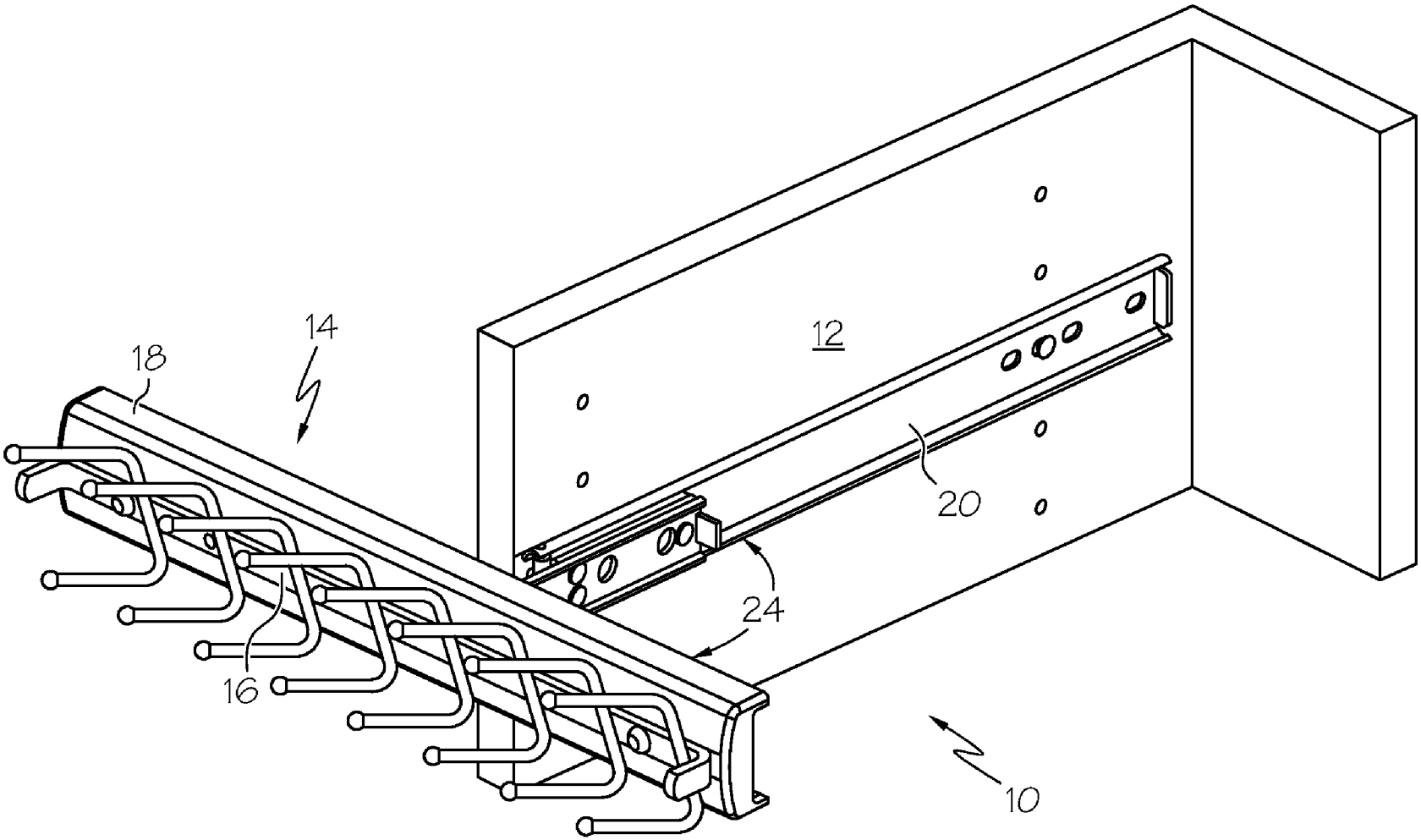
FIG. 4 is a perspective view of the hanger assembly of FIG. 3, shown in a further pivoted position.

FIG. 3 depicts the hanger assembly of FIG. 2 in a fully extended and partially pivoted state. The hanger attachment 14 is seen pivoted at angle 24 in relation to the fixed member 20. That is, the hanger attachment 14 defines an angle 24 with the fixed member 20. FIG. 4 depicts the hanger assembly of FIG. 3 in a fully extended and fully pivoted state. Angle 24 will generally be between 1 and 90 degrees, with FIG. 4 depicting an angle of about 90 degrees. Of course, it is envisioned that angle 24 could be less than or greater than 90 degrees. In some embodiments, it is desirable to allow the hanger assembly to be pivotally rotated to the side of a partition opposite to which it is mounted. As such, the hanger attachment 14 will pivot more than 90 degrees.

In at least one embodiment, the hanger assembly may include an extendable/retractable shaft to keep the attachment in an extended or pivoted position, such as shown and described in U.S. Pat. No. 7,310,899, the entire content of which is expressly incorporated herein by reference. In some embodiments, the shaft may be spring loaded or pressurized with gas.

Figure 5:
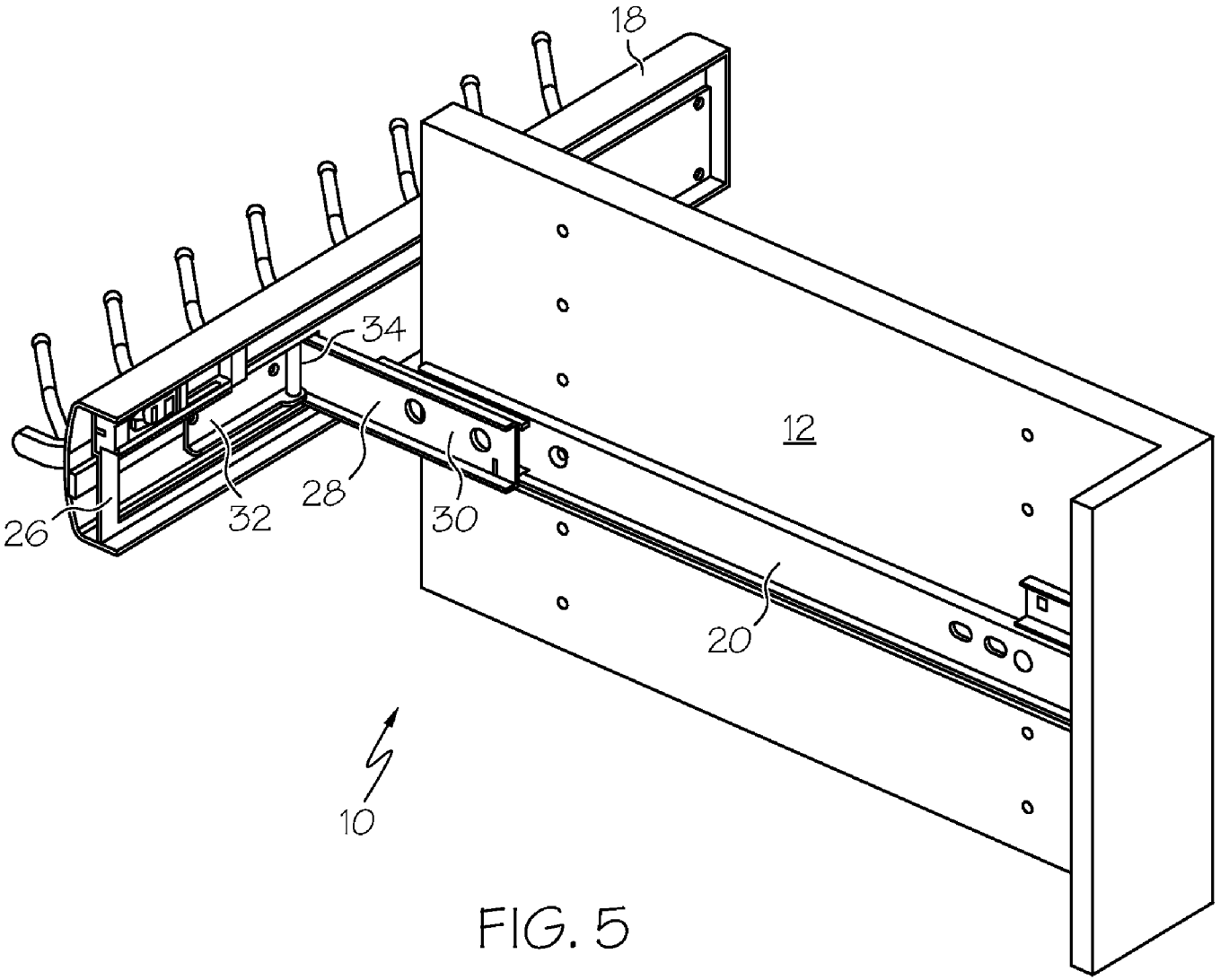
FIG. 5 is a perspective view of the hanger assembly of FIG. 4, depicting the engagement between the fixed member, the sliding arm, and the hinge.
Figure 6A:
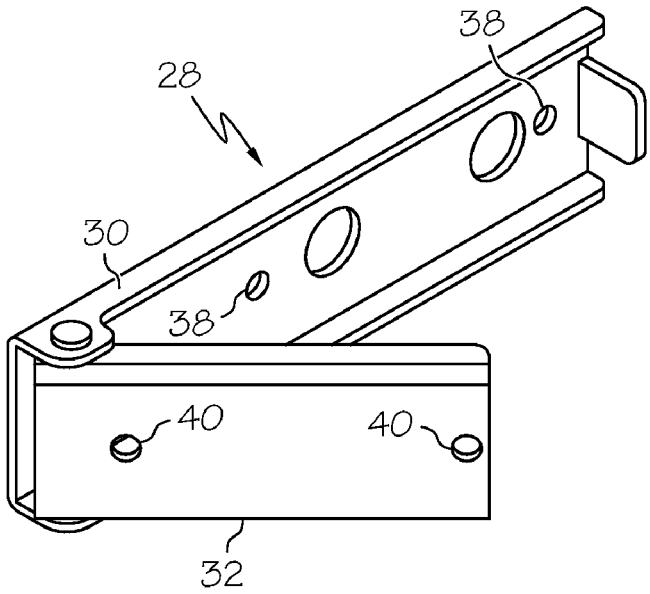
FIG. 6A depicts an embodiment of a hinge in a partially pivoted state.
Figure 6B:
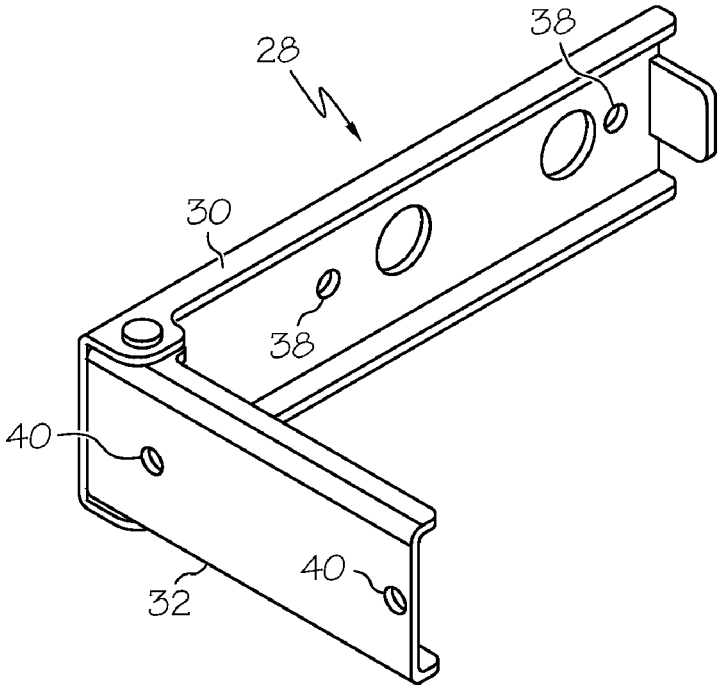
FIG. 6B depicts the hinge shown in FIG. 6A in a further pivoted state.

Turning now to FIG. 5, the hanger assembly 10 is shown in more detail. The sliding rail assembly includes the fixed member 20, the sliding arm 26, and a hinge 28. As seen in FIG. 5, the hinge 28 connects the sliding arm to the fixed member. More specifically, the hinge, which is shown in more detail in FIGS. 6A-6B, has a first portion 30 that is slidably engaged to the fixed member 12 and a second portion that is fixedly engaged to the sliding arm 26. The first portion 30 of the hinge is pivotally engaged to the second portion 32 via pin 34. The sliding arm 26 is enclosed within the housing 18.

Figure 7:
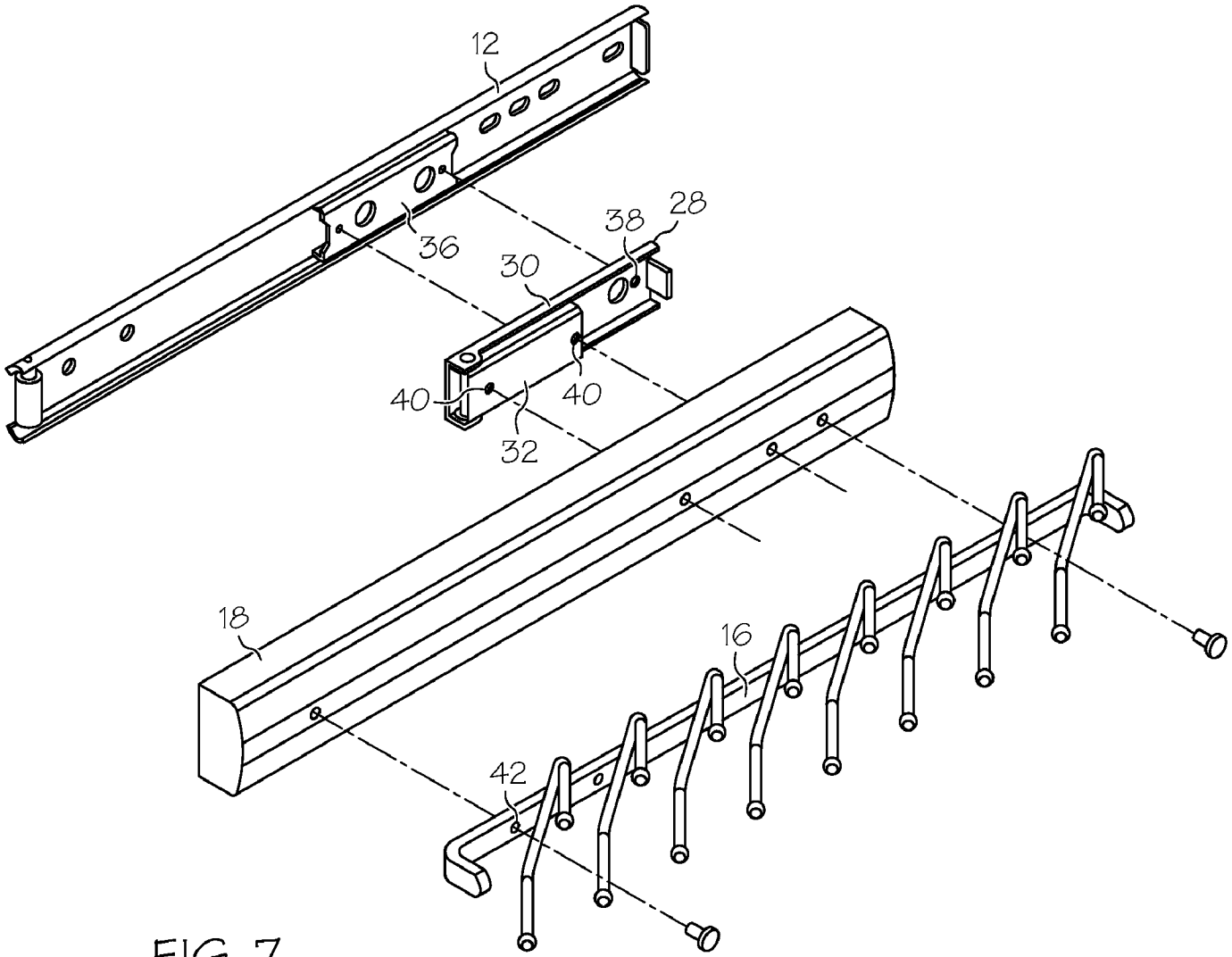
FIG. 7 is an exploded view of an embodiment of a portion of the hanger assembly shown in FIG. 1.

FIG. 7 shows an exploded view of an embodiment of a portion of the hanger assembly 10. In the embodiment shown in FIG. 7, a mounting member 36 is slidably engaged to the fixed member 12. The first portion 30 of the hinge 28 is mounted to the mounting member 36 via securement elements such as screws (not shown) through securement holes 38, seen in FIGS. 6A, 6B, and 7. The second portion 32 of the hinge 28 is mounted through the sliding arm (not shown) to the housing 18 via securement elements through securement holes 40. In such a manner, the hinge slides relative to both the fixed member and the sliding arm.

FIG. 7 further depicts one method of engaging hanger member 16 to the housing 18 via securement elements through securement holes 42. The design of the present invention allows various styles of hanger members to be used. For example, the hanger members can be valet rods, tie racks, belt racks, clothing racks, hangers, hooks, or any combination thereof Embodiments of such hanger members can be seen in U.S. Pat. No. 6,679,392, the entire content of which is hereby incorporated by reference.

Figure 8:
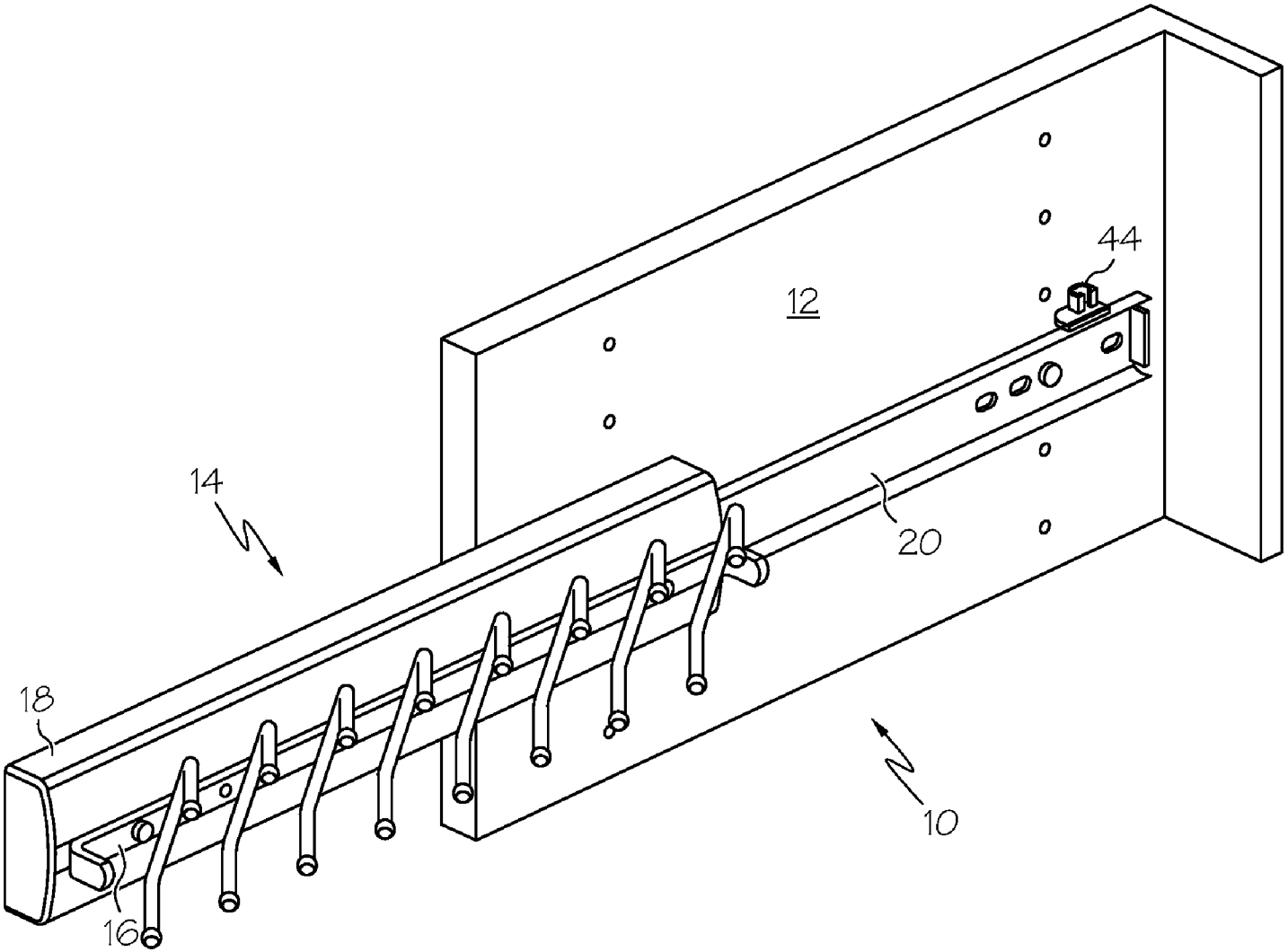
FIG. 8 is a perspective view of another embodiment of the hanger assembly shown in FIG. 1.
Figure 9:
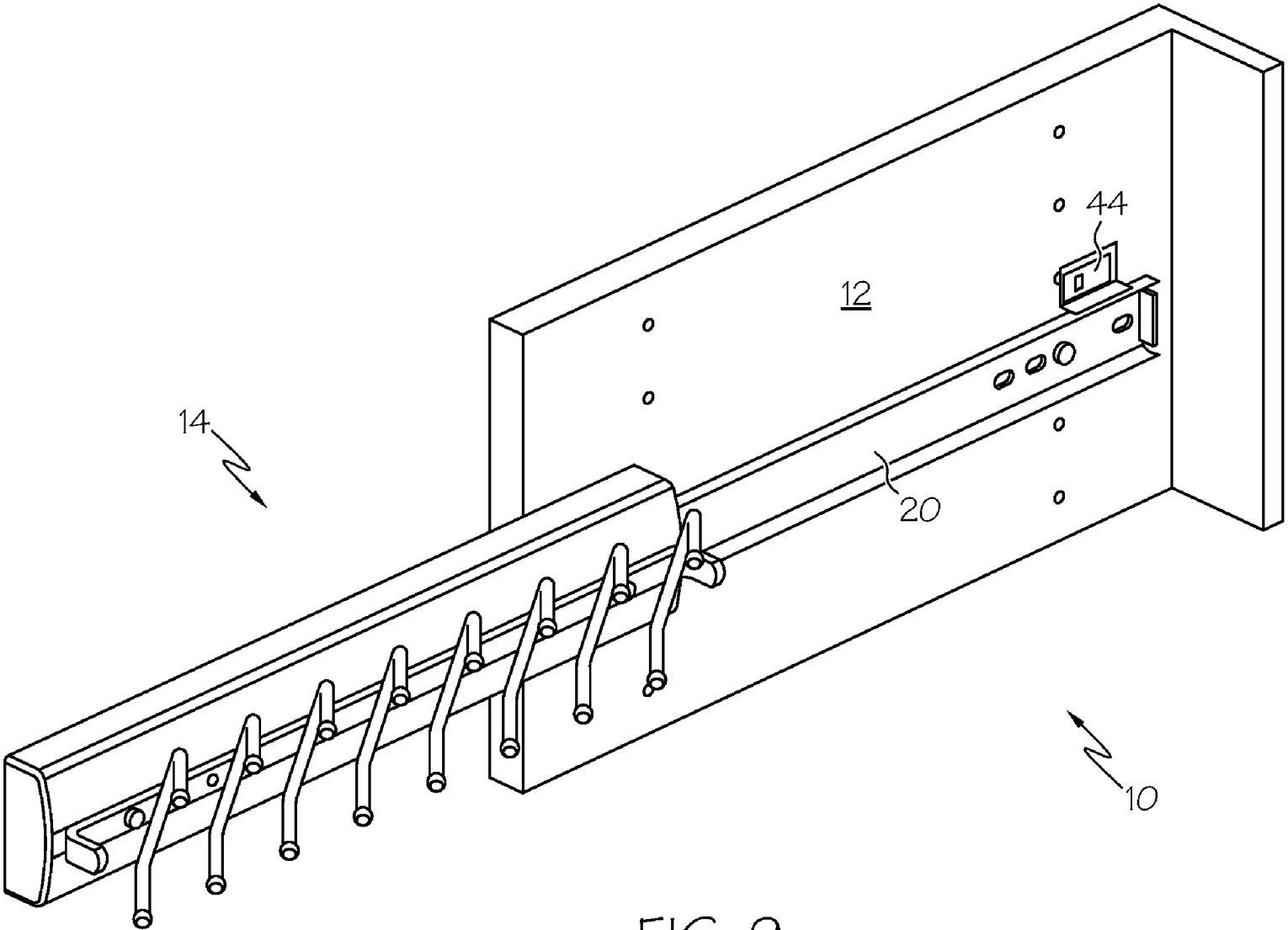
FIG. 9 is a perspective view of another embodiment of the hanger assembly shown in FIG. 1.

Referring now to FIGS. 8 and 9, the hanger assembly can include various stopping members 44. Stopping members 44 can be included to adjust the retracted position of the hanger assembly. For example, in the embodiment depicted in FIG. 2, the sliding arm is allowed to fully retract in the absence of a stopping member. In contrast, in FIGS. 8 and 9 the final retracted position of the assembly is controlled by the position of the stopping member 44. The stopping member 44 may be a tab made of plastic, metal, or other durable material, as in FIG. 8, or the stopping member 44 may be a flange as in FIG. 9

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

This completes the description of the preferred and alternate embodiments of the invention. Those skilled in the art may recognize other equivalents to the specific embodiment described herein which equivalents are intended to be encompassed by the claims attached hereto.

What is claimed is:

1. A hanger assembly comprising:

a sliding rail assembly comprising a fixed member, a sliding arm, and a hinge, the hinge having a first portion and a second portion, wherein the first portion is pivotally engaged to the second portion, and wherein the first portion is slidably engaged to the fixed member and the second portion is fixedly engaged to the sliding arm, wherein an angle is defined between the first portion and the second portion, the sliding rail assembly having a non-pivoted state and a pivoted state, wherein in the non-pivoted state, the second portion contacts the first portion such that the angle is 0 degrees and the sliding arm is parallel to the fixed member, and wherein in the pivoted state, the angle is at least 1 degree and the sliding arm is not parallel to the fixed member; and a hanger attachment being engaged to at least a portion of the sliding arm.

2. The hanger assembly of claim 1, wherein in the pivoted state the angle is between 1 and 90 degrees.

3. The hanger assembly of claim 1, wherein in the pivoted state the angle is at least 90 degrees.

4. The hanger assembly of claim 1, wherein the hanger attachment comprises a housing and a hanger member.

5. The hanger assembly of claim 4, wherein the hanger member is selected from at least one member of the group consisting of: valet rods, tie racks, belt racks, clothing racks, hangers, hooks, and any combination thereof.

6. The hanger assembly of claim 1, wherein the fixed member is engaged to a partition.

7. A hanger assembly having a stowed position, an extended position, and a pivoted position, the hanger assembly comprising:

a fixed member;

a sliding arm fixedly engaged to a hanger attachment, the hanger attachment comprising a housing and at least one hanger member; and a hinge having a first portion and a second portion pivotally engaged to the first portion, wherein the first portion of the hinge is slidably engaged to the fixed member and the second portion of the hinge is fixedly engaged to the sliding arm, wherein in the stowed position, the second portion of the hinge contacts the first portion of the hinge and the housing overlaps the entire fixed member, wherein in the extended position, the second portion of the hinge contacts the first portion of the hinge and the sliding arm is parallel to the fixed member, and wherein in the pivoted position, the second portion of the hinge is pivoted relative to the first portion of the hinge such that an angle is defined between the sliding arm and the fixed member.

8. The hanger assembly of claim 7, wherein in the extended position the angle is between 1 and 90 degrees.

9. The hanger assembly of claim 7, wherein in the extended position the angle is at least 90 degrees.

10. The hanger assembly of claim 7, wherein the hanger member is selected from at least one member of the group consisting of: valet rods, tie racks, belt racks, clothing racks, hangers, hooks, and any combination thereof.

11. The hanger assembly of claim 7, wherein the fixed member is engaged to a partition.

* * * * *